United States Patent [19]

Nasu et al.

[11] 4,281,322

[45] Jul. 28, 1981

[54] FUSE BLOWING DETECTOR

[75] Inventors: Tetsuji Nasu, Yokohama; Mitsuyoshi Nagayama, Fujisawa, both of Japan

[73] Assignee: Nissan Motor Company, Ltd., Kanagawa, Japan

[21] Appl. No.: 75,181

[22] Filed: Sep. 12, 1979

[30] Foreign Application Priority Data

Oct. 4, 1978 [JP] Japan ..... 53-135498[U]

[51] Int. Cl.[3] ..... G08B 21/00

[52] U.S. Cl. ..... 340/638; 340/639; 337/206

[58] Field of Search ..... 340/639, 638; 339/150 F, 252 F, 253 F, 262 F; 361/341, 349; 337/206, 212, 241, 242, 196; 200/61.7

[56] References Cited

U.S. PATENT DOCUMENTS

| | | | |
|---|---|---|---|
| 2,317,030 | 4/1943 | Colvin | 340/639 |
| 2,774,960 | 12/1956 | Podell | 340/639 |
| 3,139,499 | 6/1964 | Cosgrove | 337/206 |
| 3,163,728 | 12/1964 | Martin | 337/212 |
| 3,218,413 | 11/1965 | Koch | 337/206 |
| 3,225,163 | 12/1965 | Linton | 337/196 |
| 3,465,280 | 9/1969 | Paganelli | 340/638 |
| 3,546,692 | 12/1970 | Salzer | 340/639 |
| 3,699,433 | 10/1972 | Smith, Jr. | 340/638 |

OTHER PUBLICATIONS

"Fuse Monitor for Cars", *Practical Electronics*, vol. 12, #3, p. 239, Mar. 1979.

*Primary Examiner*—Gerald L. Brigance
*Attorney, Agent, or Firm*—Lowe, King, Price & Becker

[57] ABSTRACT

A device for detecting whether any of a plurality of fuses has blown out. The fuses are connected between a first terminal of an electrical source and a number of loads, the loads also being connected to the other terminal of the source. The device comprises one light emitting element for each fuse. One end of the light emitting element is connected to a junction between the fuse and its load. The other ends of the light emitting elements are all connected together to one terminal of a switch, having another terminal connected to the other terminal of the electrical source. When the switch is closed, the light emitting element corresponding to any fuse which has blown out is not lit.

18 Claims, 5 Drawing Figures

FUSE BLOWING DETECTOR

BACKGROUND OF THE INVENTION

The present invention relates generally to a device for detecting whether any one of a number of fuses in an electrical system has blown out.

A machine, such as an automobile, which incorporates a large number of electrical devices, such as ignition loads, radio sets, various different lamps, etc., requires a relatively large number of fuses for protecting the loads from excessive current, and for guarding against fire and so on caused by short circuits. Various devices have been proposed for detecting whether any of thses fuses have been blown out. For example, a fuse blowing detector such as shown in FIG. 1 of the accompanying drawings has been suggested. In this device, an automobile has an electric system which includes loads L1, L2, L3 fed from a battery 1 through an accessory switch SW1, loads L4 and L5 fed through an ignition switch SW2, and loads L6 and L7 fed directly from the battery. These loads L1–L7 are fused by fuses F1–F7 respectively. Several switches are shown as controlling supply of power to some of the loads, such as S1, S3, S4, and S6. The fuse blowing detector shown in FIG. 1 includes wires to each of the junctions between a fuse and its load, and a slidable changeover switch 2 which has a plurality of fixed contact points **2*a* connected to the other ends of these wires. The slidable contact 2*b* is capable of contacting each of these fixed contacts, by the movement of a slide lever 3 and an indicator lamp 4 having one terminal connected to the slidable contact 2*b*** and an other terminal to the earth of the vehicle.

In operation, the ignition switch SW2 and the accessory switch SW1 are closed, and the slide lever 3 is moved to and fro. If all the fuses are intact, the lamp 4 is lighted each time slidable contact **2*b* and a fixed engage 2*a* contact. However, if any one of the fuses is blown, contact between slide lever 3 and the corresponding fixed contact, does not cause lamp 4** to light, thereby signalling blowing of the fuse.

This detector, however, has certain disadvantages because the use of a mechanical part, such as the slide lever 3, makes the detector prone to malfunctions. Another disadvantage is that the number of movements of the slide lever 3 for each test sequence is equal to the number of fuses. Further, use of only one lamp has made it difficult to know which fuse is defective.

SUMMARY OF THE INVENTION

Therefore, it is an object of the present invention to provide a device for detecting the blowing of any of a plurality of fuses, which allows the easy detection of which of the fuses is blown.

It is a further object of the present invention to provide a device of the above mentioned sort which is not liable to mechanical malfunction, and thus is of high reliability, and which is compact.

According to the present invention, a first terminal of an electrical source is connected to first terminals of a plurality of fuses, having second terminals of fuses connected to the first terminals of the same number of loads. The other terminals of the loads are connected to the other terminal of the electrical source, whereby the loads are supplied with electrical power via their respective fuses. A device for detecting the blowing of any one of the fuses comprises, for each fuse, a light emitting element, having one terminal connected to the second terminal of the fuse. A common switch for all of the light emitting elements has one terminal connected to all the other terminals of all the light emitting elements. The other terminal of the switch is connected to the other terminal of the electrical source.

According to a particular feature of the present invention, the light emitting elements are light emitting diodes. The polarities of the source and the diodes is such that, if the switch is closed, and a fuse is intact, the corresponding diode is lit.

BRIEF DESCRIPTION OF THE DRAWINGS

Other objects, features, and advantages of the present invention will become more clear from the following description of several preferred embodiments of the present invention, when taken in conjunction with the accompanying drawings, which, however, are given for illustration only. None of the particular features of any of the embodiments described, or of the drawings, are to be taken as in any way limitative of the present invention, whose scope, as well as the extent of protection sought to be afforded by Letters Patent, is to be delimited solely by the accompanying claims. In the drawings:

DESCRIPTION OF THE PREFERRED EMBODIMENTS

In the various figures, similar parts are denoted by the same reference numbers, and detailed repetitive descriptions are omitted for the sake of brevity.

Figure 1:
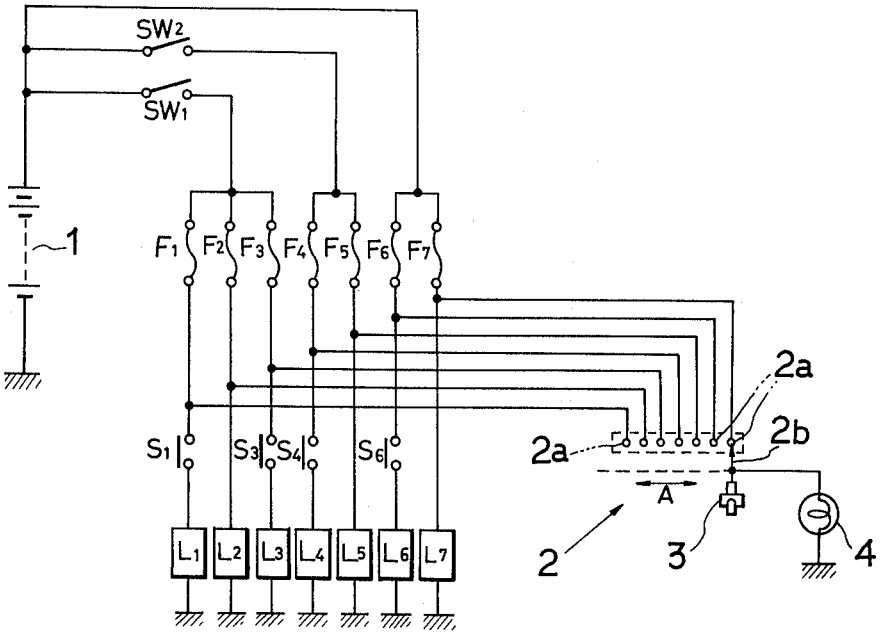
FIG. 1 PRIOR ART
FIG. 1 is a diagram of a prior art fuse blowing detector, associated with an electrical circuit of an automobile, as described supra.
Figure 2:
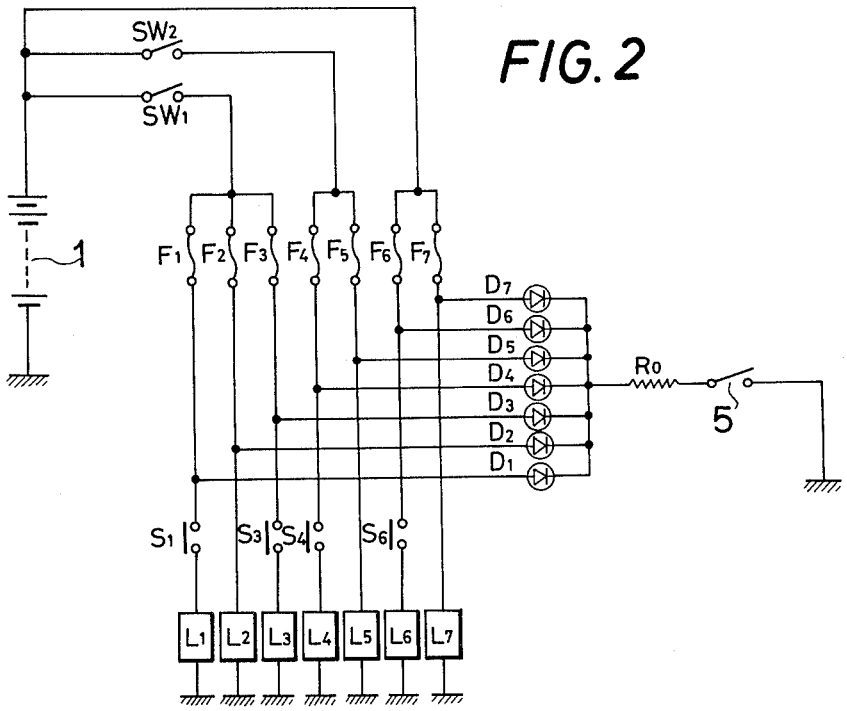
FIG. 2 is a diagram, similar to FIG. 1, of a preferred embodiment of the present invention.

Referring to FIG. 2, there is shown a circuit diagram of a preferred embodiment of the present invention, associated with an electrical circuit powered by a DC source 1, typically an automobile battery having a grounded negative terminal and a positive terminal. The terminals of source 1 are connected via plural fuses F1–F7 to plural parallel loads L1–L7. The condition of fuses F1–F7 is detected by light emitting elements D1–D7. The number of light emitting elements D1–D7, preferably light emitting diodes, is equal to the number of fuses F1–F7. The anodes of diodes D1–D7 are respectively connected to junction points between fuses F1–F7 and shunt loads L1–L7. The cathodes of all the light emitting diodes D1–D7 are connected together to a common junction, connected via switch 5 to the ground terminal of source 1, i.e., the terminal of source 1 which is not connected to fuses F1–F7. If the polarity of battery 1 is opposite to that shown, the polarity of diodes D1–D7 is reversed so, that, if a fuse is intact, and switch 5 is closed, the corresponding diode is lit.

Thus, in operation, in response to closure of switch 5 the diodes corresponding to intact fuses are lit. If any particular fuse is blown, its corresponding diode is not lit.

Figure 3:
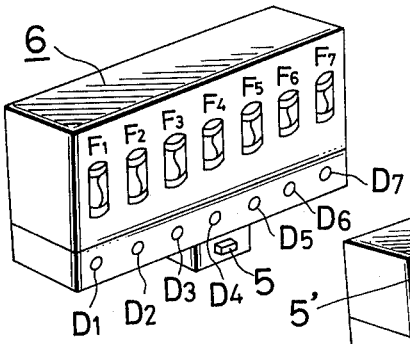
FIG. 3 is a perspective view of a block, in which fuses and light emitting elements are arranged together in an easily visible view, and an easily operable fixed switch.

FIG. 3 is a perspective view of an embodiment of the present invention in which diodes D1–D7 and fuses F1–F7 are arranged in one-to-one correspondence with one another. Diodes D1–D7 and fuses F1–F7 are easily visible in block 6 which carries switch 6 so that the switch can be easily operated.

Figure 4:
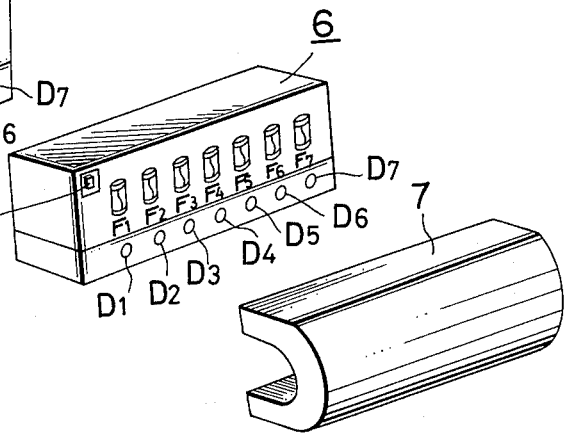
FIG. 4 is a view, similar to FIG. 3, of another embodiment of the present invention, wherein a cover is shown as removed.

FIG. 4 is an exploded perspective view of another embodiment, wherein the switch 5' is a normally closed switch that is usually open circuited by engagement with a face of the cover 7 that contacts the portion of block 6 from which switch 5' extends. When, however, cover 7 is removed from block 6, switch 5' is automatically closed so light-emitting diodes D1–D7 automatically show which fuses F1–F7, if any, are blown. Alternatively, block 6 may be part of an automobile instrument panel having a cover 7.

Figure 5:
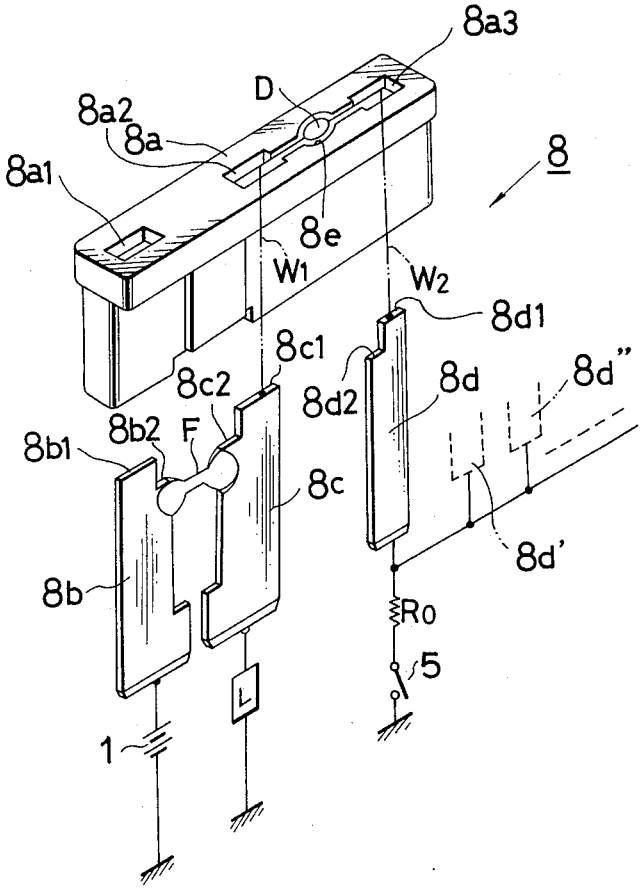
FIG. 5 is a perspective exploded view of an automobile fuse device in which the present invention is applied.

In FIG. 5 is shown a particular type of automobile fuse device to which the present invention is applied. The fuse device includes a housing 8*a* made of transparent electrically insulating resin material. In housing 8*a* are two spaced electrically conducting terminal strips 8*b* and 8*c*, which are normally electrically connected by a fuse F, which bridges a gap between the strips. If fuse F blows, strips 8*b* and 8*c* are electrically insulated from each other. Strips 8*b* and 8*c* espectively include ends 8*b*1 and 8*c*1 which fit into elongated rectangular openings 8*a*1 and 8*a*2 at the top of housing 8*a*. Strips 8*b* and 8*c* have shoulders 8*b*2 and 8*c*2 that abut on corresponding shoulders in housing 8*a*. The top of housing 8*a* includes elongated rectangular opening 8*a*3 into which is fitted end tab 8*d*1 of a third electrically conducting auxiliary terminal strip8*d*, end tab 8*d*1 extends from shoulder 8*d*2 of strip 8*d*. The top of housing 8*a* includes a circular groove 8*e* between openings 8*a*2 and 8*a*3, whereby diode D and its connecting wires are held in situ between interior strip 8*c* and strip 8*d* at the outside of the housing. The lower ends of the terminal strips 8*b*, 8*c* and 8*d* are plugged into female plugs (not shown), for easy replacement. Strip 8*b* is connected to battery 1; strip 8*c* is connected to load L for a particular branch energized by battery 1; and strip 8*d* is connected, along with all the other strips 8*d*', 8*d*'', etc., of the other similar fuse devices, to resistor Ro and switch 5 for testing the fuses F. Thus, as described supra, closing of switch 5 completes a circuit which shows immediately which of fuses F1–F7 is blown, because the diode associated with the branch is not lit.

To indicate the correct direction for insertion of the terminal strips 8*b*, 8*c*, 8*d* into the housing 8*a*, housing 8 is formed asymmetrically, or marked in some way.

The illustrated embodiment is suitable for applications in which the entire fuse elment for a branch, including housing 8 and the diode D for the particular branch, is discarded when the fuse for the branch is blown out, and a new fuse element replaces the discarded element is used.

In the above embodiments the use of light emitting diodes has been described. However, this is not essential. Small lamps may be used instead of the diodes. In this case the protective resistor Ro shown in FIGS. 2 and 5 may be omitted. If lamps are used instead of diodes, problems may occur with reverse flow of current. However, in any event when switch 5 is closed the invention operates as specified. If these reverse flow problems are severe, rectifying diodes may be provided in series with the lamps to eliminate the problems, as will be obvious to one skilled in the art, based upon the foregoing disclosure.

Although the present invention has been shown and described in terms of several preferred embodiments thereof, the exact details of any particular embodiment are subject to various modifications, changes and/or omissions, by a person of ordinary skill in the art, depending upon the foregoing disclosure, without departing from the scope or the spirit of the present invention. Therefore it is desired that the aforesaid scope, as well as the breadth of the protection granted, should be defined, not by any of these purely fortuitous details of the shown embodiments, or of the drawings, but solely by the appended claims, which follows.

What is claimed is:

1. In an electrical circuit wherein a first terminal of an electrical source is connected to first terminals of a plurality of fuses, and the second terminal of the fuses are connected to the first terminals of the same number of loads, the other terminals of the loads being connected to the other terminal of the electrical source, whereby the loads are supplied with electrical power via their respective fuses, a device for detecting the blowing of any one of the fuses, comprising:

(a) for each fuse, a light emitting element, one terminal of which is connected to the second terminal of the fuse, (b) a switch, one terminal of which is connected to all the other terminals of all the light emitting elements, and the other terminal of which is connected to the said other terminal of the electrical source, and (c) an electrically insulating housing for each fuse, each fuse being mounted in its housing between two spaced electrically conductive strips, one of the strips being connected, via the light emitting element which corresponds to the fuse, to a third electrically conductive strip mounted within the housing, the light emitting element being received in a groove on said housing, the third strips all being connected together to the switch, the one strips all being each connected to the load corresponding to this fuse, the remaining strips being connected to the electrical source.

2. A device according to claim 1, wherein the strips are formed with shoulders which act as stops and abut on the housings.

3. A fusing device for connecting an electrical source to plural loads, comprising:

(a) a fuse for each load;

(b) a light emitting element for each fuse;

(c) a separate, electrically insulating housing for each of said fuses, said housing having a groove for receiving one of the light emitting elements;

(d) each housing receiving a pair of spaced first and second electrically conductive strips for each of said fuses, one of said fuses being mounted in bridging relation between said first and second strips of each housing whereby current flows between the first and second strips via the fuse associated with the housing, said first strip being adapted to be connected to said electrical source, said second strip being adapted to be connected to a corresponding load;

(e) each housing receiving a third electrically conductive strip spaced from the first and second electrically conductive strips of the housing, said third strip being electrically connected through the light emitting element of the housing to the second strip of the housing; and (f) a switch having one terminal connected to all said third strips and another terminal adapted to be connected to said electrical source.

4. A device according to claim 1 or 2 or 3, wherein the light emitting elements are light emitting diodes, and the polarities of the source and the diodes are such that, if the switch is closed, and a fuse is intact, its corresponding diode may light.

5. A device according to claim 1 or 2 or 3, wherein the light emitting elements are electric lamps.

6. A device according to claim 1 or 2 or 3, further including a block in which the fuses and light emitting elements are arranged in an easy-to-see way in one-to-one correspondence with one another.

7. A fusing device for connecting an electrical source and a plurality of loads, comprising:

(a) a fuse for each load, each fuse connecting a corresponding load and one terminal of the electrical source;

(b) a light emitting element for each fuse, each light emitting element having first and second terminals, said terminals of each element being connected to a junction between the load and fuse corresponding to the light emitting element;

(c) a single pole, single throw switch having one terminal connected to the second terminal of all of said light emitting elements and another terminal of said switch being selectively connected to a second terminal of said electrical source; and (d) a box-like block having an outer surface on which said fuses and light emitting elements are arranged in visible one-to-one correspondence with one another.

8. The device of claim 7 wherein the terminals of said switch, electrical source and light emitting elements are connected in circuit with said fuses so that closure of the switch contacts results in current flow through operable fuses and corresponding light emitting elements, whereby the elements corresponding to the operable fuses are lit in response to the switch closure.

9. A device according to claim 7, wherein the switch is mounted in the block.

10. A device according to claim 9, wherein the switch is a switch which is normally on, and further comprising a cover for the block, which when fitted to the block presses on the switch so that it is held off; so that when the cover is removed the switch is automatically connected.

11. A device according to claim 10, wherein the block is provided in the instrument panel of an automobile, and the cover is an instrument panel cover.

12. A circuit for independently indicating the status of fuses of branch circuits powered by a single source in response to closure of a single pole, single throw switch, each of the branch circuits including a fuse and load electrically connected across opposite terminals of the source and an intermediate terminal between the load and fuse, said circuit comprising the single pole, single throw switch, said switch having one terminal connected to the one terminal of the source connected to the load, and a separate current responsive light source for each branch, one terminal of each light source being connected to the intermediate terminal of the branch associated with the light source, one terminal of each light source being connected to a second terminal of the switch, whereby closure of the switch contacts results in current flow through each of the light sources connected to branches having operative fuses causing the light sources connected to the branches having operative fuses to be lit, a common block in which all of said light sources are positioned to enable the sources to be viewed while the switch is closed.

13. The circuit of claim 12 further including a cover for said block, said cover including a face for engaging an actuator for the switch contacts to maintain the contacts in an open circuited condition and for obscuring the light sources while the cover is on the block, the contacts being closed when the cover is off the block and the light sources are not obscured by the cover.

14. The circuit of claim 12 wherein each branch is contained in an electrical insulating housing adapted to be mounted in the block, each of said housings having: a top with first, second and third openings, first, second and third electrically conducting strips having first ends respectively secured in said first, second and third openings and extending from the openings in generally the same direction, the fuse bridging the first and second strips, the light source being mounted in the housing between and electrically connected to said second and third strips, the other ends of said first, second and third strips being respectively electrically connected to one terminal of the source, one terminal of the load and one terminal of the switch.

15. The circuit of claim 14 wherein the single source is a DC power supply and the light source is a light emitting diode polarized to pass current from the DC power supply in response to the switch contacts being closed and the fuse being operative, each housing being easily removed and inserted in the block and asymmetrically arranged to assure proper polarization of the diode in the circuit.

16. A circuit for independently indicating the status of fuses of branch circuits powered by a single source in response to closure of a single pole, single throw switch, each of the branch circuits including a fuse and load electrically connected across opposite terminals of the source and an intermediate terminal between the load and fuse, said indicator circuit comprising the single pole, single throw switch, said switch having one terminal connected to one terminal of the source and a separate current responsive light source for each branch, one terminal of each light source being connected to the intermediate terminal of the branch associated with the light source, one terminal of each light source being connected to a second terminal of the switch, whereby closure of the switch contacts results in current flow through the light sources to indicate which of the fuses are operative, a common block in which all of said light sources are positioned, said block having an outer surface on which said fuses and light sources are arranged in visible one-to-one correspondence with one another.

17. The circuit of claim 16 wherein each branch is contained in an electrical insulating housing adapted to be mounted in the block, each of said housings having: a top with first, second and third openings, first, second and third electrically conducting strips having first ends respectively secured in said first, second and third openings and extending from the openings in generally the same direction, the fuse bridging the first and second strips, the light source being mounted in the housing between and electrically connected to said second and third strips, the other ends of said first, second and third strips being respectively electrically connected to one terminal of the source, one terminal of the load and one terminal of the switch.

18. The circuit of claim 17 wherein the single source is a DC power supply and the light source is a light emitting diode polarized to pass current from the DC power supply in response to the switch contacts being closed and the fuse being operative, each housing being easily removed and inserted in the block and asymmetrically arranged to assure proper polarization of the diode in the circuit.

* * * * *